US009101179B2

(12) United States Patent
Marvin et al.

(10) Patent No.: US 9,101,179 B2
(45) Date of Patent: Aug. 11, 2015

(54) SMOOTH SHOE UPPERS AND METHODS FOR PRODUCING THEM

(71) Applicant: Reebok International Limited, London (GB)

(72) Inventors: William Marvin, Canton, MA (US); Paul Litchfield, Westborough, MA (US); Brian Christensen, Centerville, MA (US); Paul Davis, Blackstone, MA (US)

(73) Assignee: Reebok International Limited, London (GB)

( * ) Notice: Subject to any disclaimer, the term of this patent is extended or adjusted under 35 U.S.C. 154(b) by 0 days.

(21) Appl. No.: 14/037,025

(22) Filed: Sep. 25, 2013

(65) Prior Publication Data

US 2014/0026439 A1 Jan. 30, 2014

Related U.S. Application Data

(63) Continuation of application No. 11/733,744, filed on Apr. 10, 2007, now Pat. No. 8,544,191.

(51) Int. Cl.
*A43B 23/02* (2006.01)
*A43B 9/12* (2006.01)
(Continued)

(52) U.S. Cl.
CPC ..... *A43B 23/0245* (2013.01); *A43B 9/12* (2013.01); *A43B 23/0205* (2013.01); *A43B 23/0215* (2013.01); *A43B 23/0255* (2013.01); *A43B 23/0295* (2013.01); *A43B 23/07* (2013.01);
(Continued)

(58) Field of Classification Search
CPC .. A43B 23/02; A43B 23/025; A43B 23/0255; A43B 23/026; A43B 23/047
USPC ..... 12/146 C, 146 CK, 142 A, 142 B, 142 C, 12/142 F; 36/45, 46.5, 4, 107
See application file for complete search history.

(56) References Cited

U.S. PATENT DOCUMENTS 2,072,875 A 3/1937 Gray
3,035,291 A * 5/1962 Bingham, Jr. ..... 12/142 RS
(Continued)

FOREIGN PATENT DOCUMENTS

CN 1633248 6/2005
DE 196 30 603 2/1998
(Continued)

OTHER PUBLICATIONS

Bemis Seam Sealing © 1998-2002.
(Continued)

*Primary Examiner* — Jila M Mohandesi
(74) *Attorney, Agent, or Firm* — Sterne, Kessler, Goldstein & Fox P.L.L.C.

(57) ABSTRACT

Shoe uppers having smooth seams and methods for producing them are disclosed. In one embodiment the upper uses thermoplastic seam tape which forms bonds between contiguous upper sections after being subjected to heat and/or pressure. In another embodiment, different parts of the shoe can be joined using hidden seams. Close seams can also be covered with a transfer material adapted to give the interior and/or exterior of the upper a smooth surface. In yet another embodiment, a method is disclosed which allows three-dimensional upper sections to be bonded on a last using thermoplastic seam tape.

24 Claims, 12 Drawing Sheets

(51) Int. Cl.
*A43B 23/07* (2006.01)
*A43D 25/18* (2006.01)

(52) U.S. Cl.
CPC ..... *A43D 25/18* (2013.01); *A43B 23/024* (2013.01); *A43B 23/025* (2013.01)

(56) References Cited

U.S. PATENT DOCUMENTS

| | | | | |
|---|---|---|---|---|
| 4,295,238 | A * | 10/1981 | Clark | 12/142 RS |
| 5,253,434 | A | 10/1993 | Curley, Jr. et al. | |
| 5,285,546 | A | 2/1994 | Haimerl | |
| 5,289,644 | A | 3/1994 | Driskill et al. | |
| RE34,890 | E | 4/1995 | Sacre | |
| 5,422,173 | A | 6/1995 | Stahl | |
| 5,433,021 | A | 7/1995 | Mahler | |
| 5,664,343 | A | 9/1997 | Byrne | |
| 5,933,897 | A * | 8/1999 | MacDonald | 12/142 R |
| 6,604,302 | B2 | 8/2003 | Polegato | |
| 6,763,610 | B2 | 7/2004 | Issler | |
| 6,830,647 | B2 | 12/2004 | Kitano et al. | |
| 6,860,036 | B2 | 3/2005 | Zhu | |
| 7,117,545 | B2 * | 10/2006 | Hannon et al. | 2/275 |
| 7,127,833 | B2 | 10/2006 | Haimerl | |
| 7,169,249 | B1 | 1/2007 | Nordstrom | |
| 7,174,572 | B1 | 2/2007 | Diamond et al. | |
| 7,347,011 | B2 | 3/2008 | Dua et al. | |
| 7,356,946 | B2 * | 4/2008 | Hannon et al. | 36/45 |
| 7,434,272 | B2 * | 10/2008 | Hannon et al. | 2/275 |
| 7,637,032 | B2 | 12/2009 | Sokolowski et al. | |
| 2002/0066212 | A1 | 6/2002 | Pavelescu et al. | |
| 2002/0172792 | A1 | 11/2002 | Jarvis et al. | |
| 2003/0126673 | A1 | 7/2003 | Yardley | |
| 2004/0139629 | A1 * | 7/2004 | Wiener | 36/12 |
| 2004/0176005 | A1 | 9/2004 | Nordstrom | |
| 2004/0216332 | A1 | 11/2004 | Wilson et al. | |
| 2005/0102863 | A1 * | 5/2005 | Hannon et al. | 36/57 |
| 2005/0138845 | A1 | 6/2005 | Haimerl | |
| 2005/0210708 | A1 | 9/2005 | Chen | |
| 2005/0223475 | A1 | 10/2005 | Turner | |
| 2006/0010562 | A1 | 1/2006 | Bevier | |
| 2006/0150302 | A1 | 7/2006 | Warren et al. | |
| 2007/0022627 | A1 | 2/2007 | Sokolowski et al. | |
| 2008/0110048 | A1 | 5/2008 | Dua et al. | |
| 2008/0110049 | A1 | 5/2008 | Sokolowski et al. | |
| 2008/0196181 | A1 | 8/2008 | Dua et al. | |

FOREIGN PATENT DOCUMENTS

| | | |
|---|---|---|
| DE | 199 17 369 | 10/2000 |
| DE | 100 58 094 | 5/2002 |
| EP | 0 976 337 | 2/2000 |
| EP | 1 522 228 | 4/2005 |
| EP | 1 559 338 | 8/2005 |
| WO | WO 03-070041 | 8/2003 |

OTHER PUBLICATIONS

Bemis Sewfree © 1998-2002.
Bemis General Guidelines for Using Heat Seal Film Adhesives in Embroidery Applications, Feb. 2000.
International Search Report, Application No. PCT/US2008/004581, dated Jul. 25, 2008, 5 pages.
Written Opinion of the International Searching Authority, Application No. PCT/US2008/004581, dated Jul. 25, 2008, 7 pages.
European Search Report, Application No. EP 08 742 683.9, dated Mar. 3, 2015, 6 pages.

* cited by examiner

SMOOTH SHOE UPPERS AND METHODS FOR PRODUCING THEM

CROSS-REFERENCE TO RELATED APPLICATION

This application is a continuation of U.S. application Ser. No. 11/733,744, filed Apr. 10, 2007, which is incorporated herein in its entirety by reference thereto.

BACKGROUND OF THE INVENTION

1. Field of the Invention

The present invention relates generally to footwear, and more particularly to shoe uppers having smooth interior and/or exterior upper surfaces and related methods to produce such shoe uppers.

2. Background Art

Shoe uppers generally have been formed by stitching together a plurality of exterior panel sections. These exterior panel sections can be made of leather, synthetic leather, plastic, mesh, textile, or other materials. Conventional stitching is time consuming, labor-intensive, and costly wherein the end result is an aesthetically-unpleasing seam line. The conventionally stitched seam also suffers from the drawbacks of adding excess weight to the shoe and having a thick profile which can be uncomfortable for the wearer. It is often desirable to use open-faced materials for the exterior panel sections, for example mesh materials, to enhance the breathability of the shoes. These materials are particularly appropriate for athletic shoes. Such materials are challenging to join together using conventional stitching techniques. A designer of shoe uppers may wish to produce an upper with a highly curved three-dimensional surface formed from an assembly of three-dimensional panel sections. Such a surface may require seams that would prohibit the use of conventional stitching machines, which are generally limited to two-dimensional (flat) bonding applications.

The interior linings of shoes have generally also comprised several panels or sections which are stitched together at various interior seams. Since the lining directly abuts the wearer's foot, these seams can become sources of irritation or discomfort to the wearer.

In an effort to avoid or reduce the disadvantages inherent with using conventional stitching to join exterior panel sections of a shoe upper, designers have experimented with a variety of unitary shoe upper designs. These designs suffer from several disadvantages that paneled uppers do not. For example, it is difficult to construct a unitary upper that displays different characteristics (such as rigidity, thickness, or cushioning) in different areas of the upper. Either the designer will have to settle for an upper that has uniform characteristics, or additional costly and time-consuming manufacturing steps will have to be incorporated. Another drawback to unitary uppers is that they are often not as aesthetically pleasing to the consumer as an upper formed by a plurality of exterior panel sections.

Accordingly, there is a need to have an improved shoe upper which combines the advantages of both the paneled (sectional) and unitary shoe upper designs without inheriting the limitations or disadvantages of either. It is desirable to have a sectional shoe upper that has strong, aesthetically-pleasing seams of low profile which can be produced in a cost-effective and timely manner. The improved upper should allow the designer to be free to select from a wide variety of upper materials and upper shapes, including three-dimensional shapes. There is also a need to minimize or reduce the discomfort generated from interior lining seams.

BRIEF SUMMARY OF THE INVENTION

Described herein are shoe uppers having smooth seams and methods for producing them.

In one embodiment, an upper for an article of footwear comprises an exterior portion, wherein the exterior portion further comprises a plurality of exterior panels and wherein at least two contiguous exterior panels are joined at least partially to one another by at least one close seam in a stitchless manner. One or more of the exterior panels may be made of a mesh material. In one embodiment, the mesh material is overlaid with at least one adhesive film adapted to give the upper an aesthetically pleasing appearance. One or more of the exterior panels may comprise an inflatable bladder. The close seam comprise thermoplastic seam tape adapted to join the contiguous exterior panels at the close seam, such as thermoplastic seam tape comprising a material selected form the group consisting of polyurethane, polyamide, polyester, nylon, polyolefin, vinyl, polypropylene, thermoplastic urethane, tricot, acrylic, and PVC and the thermoplastic seam tape comprises two sided thermoplastic adhesive. Further, the close seam may be covered with a transfer material adapted to give the exterior portion of said shoe a smooth look and feel. The upper may further comprise an interior portion, wherein the interior portion has an interior portion upper edge and the exterior portion has an exterior portion upper edge; wherein the exterior portion is attached to the interior portion at least partially by stitching at a hidden seam located along the juncture of the interior portion upper edge and the exterior portion upper edge. A tongue pad and/or a plurality of shoelace eyelets may be attached to the upper at least partially by the hidden seam located along the juncture of the interior portion upper edge and the exterior portion upper edge.

In one embodiment, a method of making a shoe upper having a plurality of upper sections comprises the steps of overlaying a portion of a thermoplastic seam tape on a portion of a first upper section; forming a first bond between the first upper section and the thermoplastic seam tape; overlaying a portion of a second upper section on said portion of said thermoplastic seam tape; and forming a second bond between the second upper section and the thermoplastic seam tape such that a close seam is formed between the first and second upper sections.

In another embodiment, a method of making a shoe upper having a plurality of upper sections comprising the steps of overlapping a portion of a first upper section and a portion of a second upper section thereby defining an overlap region; positioning a thermoplastic seam tape over at least a portion of said overlap region such that the thermoplastic seam tape is in direct contact with a surface of said first upper section and a surface of said second upper section; and forming a first bond between the surface of the first upper section and the thermoplastic seam tape and a second bond between the surface of the second upper section and the thermoplastic tape such that a close seam is formed between the first and second upper sections. At least a portion of the overlap region may be stitched prior to forming the first and second bonds, such that the thermoplastic seam tape substantially covers the stitched portion.

In another embodiment, a method of making a shoe upper having a plurality of upper sections comprises the steps of arranging said plurality of upper sections on a shaped surface having an outer shape substantially corresponding to a desired three-dimensional shape for said upper, such that each panel is contiguous to at least one other panel and one or more bonding margins are formed between said contiguous panels; positioning thermoplastic seam tape along at least a portion of one or more of said bonding margins; forming a bond between said thermoplastic seam tape and two or more of said contiguous upper sections such that a close seam is formed at one or more of said bonding margins. At least one of the plurality of upper sections may be a three-dimensional upper section, such as a molded three-dimensional upper section.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1A:
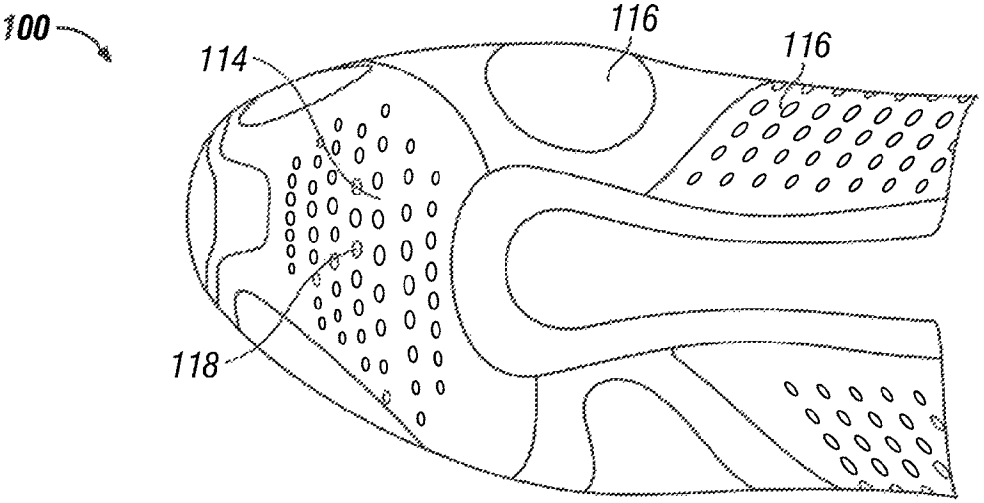
FIG. 1 is a perspective view of the lateral side of an assembled shoe upper and partial top view of the assembled shoe upper.

The present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing form the spirit and scope of the invention.

As used herein, a close seam is formed by the joining of two contiguous exterior or interior upper panels using conventional or non-conventional methods. These close seams could comprise traditional stitching or may be formed by stitchless techniques, including, but not limited to, RF welding, ultrasonic welding and cementing. Alternatively, as described in greater detail below, close seams may be formed by thermoplastic seam tape, hidden seams, or combinations thereof. Close seams may join only two contiguous panels, each on opposing sides of the close seam; or close seams may join more than two contiguous exterior panels.

Conventional shoe uppers having close seams formed by stitching or otherwise joining together a plurality of exterior panel sections may be aesthetically unpleasing because of the presence of stitching lines or the like between contiguous exterior upper panel sections. Likewise, the interior linings of conventional shoe uppers comprised of one or more interior upper panels sections which are stitched or otherwise joined together at various interior close seams, may become sources of irritation or discomfort to the wearer, as the stitching lines or the like between contiguous interior upper panel sections abut against the wearer's foot. In an effort to alleviate these drawbacks of conventional footwear construction, according to the present invention, smooth surfaces may be created along close seams on both the exterior and interior surfaces of a shoe upper to provide a more aesthetically pleasing and more comfortable article of footwear.

According to the present invention, thermoplastic seam tape can be used to overlay and/or join contiguous exterior and interior upper panels at a close seam. An example of suitable seam tape for use in shoe uppers is produced by Bemis Associates, Inc. of Shirley Mass. Such seam tapes are characterized by having a melting temperature lower than that of the material they are being used to join. Seam tapes can be made from a variety of materials such as polyurethane, polyamide, polyester, nylon, polyolefin, vinyl, polypropylene, thermoplastic urethane, tricot, acrylic, PVC and the like, or any combinations and blends thereof. Upon a sufficient application of heat and/or pressure, the material can be made to soften or melt so as to mingle with the material of the adjacent panels. After the material cools, a strong bond is formed between the panels without leaving a bulky stitch line.

Whether joining similar or dissimilar materials by stitching, welding, cementing, or other techniques, close seams typically create a gap/interruption or layering of contiguous materials at the close seam. According to the present invention, thermoplastic seam tape can be used to bridge the gap or smooth over the union of overlapping layers. Accordingly, smooth, continuous comfort can be provided to the wearer. Such technique is particularly useful for the interior of the upper, but can also be employed on the exterior of the upper to provide a smooth look and/or feel.

In a stitchless embodiment of the present invention, thermoplastic seam tapes can produce strong, aesthetically-pleasing seams of low profile which can be produced in a cost-effective and timely manner. The improvement over conventional stitching should allow the upper designer to be free to select from a wider variety of upper materials and upper shapes. The seams can also be waterproof. Thermoplastic tapes can be soft and highly elastic which can be used advantageously in applications where stretch and recovery are required. Another advantage that stitchless seams offer is weight reduction. An upper bonded with thermoplastic seams may weigh considerably less than the previous cut-and-sew designs. Adhesive films can bond open face materials like laces, meshes, nets and the like, which are difficult and expensive to join using conventional stitching means. This gives the upper designer a much wider variety of materials to select from. In addition to the design related advantages discussed above, there are significant financial advantages to replacing conventional stitching with thermoplastic seam tape. For example, the ability to bond several components together in one step may allow for a reduction in labor. In some instances, fewer components are needed to construct a bonded shoe than a stitched shoe.

Thermoplastic adhesive films bond using a synergistic combination of chemical adhesion and mechanical bonding. Adhesive films require heat or a combination of heat and pressure, and time to activate, as will be discussed more fully below. After absorbing sufficient heat and/or the application of an appropriate pressure, the adhesive melts, flows, and penetrates into the substrate. The chemical adhesion between melted adhesive and the substrate along with the degree of penetration of adhesive into the substrate is what creates the bond. The adhesive component of the bond results from attractive forces between the adhesive and the substrate. These attractive forces may be from a type of van der Waals force that arises from the mutual attraction of polar molecules. The mechanical component of the bond results from the physical penetration of the melted adhesive into the substrate and the subsequent cooling and hardening of the adhesive. The adhesive films can be specifically formulated to adhere to various substrate types.

The upper designer can choose from a variety of adhesive options that will result in an optimal close seam bond most suited to a specific type of shoe upper according to, among other things, the upper substrates selected and the geometry of the upper design. Example adhesive options are chemistry, thickness, softening point, and melt flow index, as will be more fully discussed below. This list of options is not all inclusive, as other adhesive options are known in the art.

Examples of some common adhesives chemistries available in the art are polyurethane, polyamide, polyester, nylon, polyolefin, vinyl, polypropylene, thermoplastic urethane, tricot, acrylic, PVC and the like, or any combinations and blends thereof. A person having ordinary skill in the art would know of other adhesive chemistries. The thickness, or gauge, of the adhesive film has a major impact on the bond strength. Generally, heavier weight upper materials will require thicker adhesive films for proper bonding. The weight of the upper section along with the minimum tolerable bond strength will dictate what gauge adhesives should be used for the application. A non-limiting exemplary range is 0.002" to 0.006" gauge adhesive. Routine testing and experimentation will reveal the optimum thickness to achieve a specified bond strength while minimizing weight, seam profile, and raw material costs. The softening point of the adhesive is the temperature where the adhesive film first starts to melt and flow. As a general guide for manufacturing purposes, the minimum recommended temperature to activate an adhesive film is approximately 25° F. above its softening point. The melt flow index (also known in the art as melt flow rate and melt index) describes how the adhesive flows after it melts. High melt flow index adhesives flow faster after melting; while low melt flow index adhesives flow slower after melting. Since high flow rate adhesives can penetrate better into substrates, they generally form a stronger mechanical bond. In selecting an adhesive chemistry for a particular application, it is useful to know that the melt flow rate is inversely proportional to the molecular weight and to the viscosity of the particular adhesive chosen.

It is important to establish the correct heat sealing conditions and monitor them during production. The parameters of temperature, pressure, and time should be precisely controlled to ensure a strong and durable bond. In one embodiment, the bonding apparatus can be a heat seal press. Heat seal presses are widely available and come in many different shapes and forms. An exemplary heat seal press has two flat heated plates. The plates may be closed by, for example, a pneumatic cylinder. A timer usually controls heat sealing cycle. Temperature and pressure can be adjusted to optimum levels for any specific application. As is known in the art, alternatives to heat seal presses comprise heated nip rolls, hot calendering techniques, ultrasonic welding techniques, RF welding techniques, lasers in conjunction with nip rolls or presses, hot air sealing machines, and combinations thereof or the like. Although not required, heat and pressure are usually applied simultaneously.

The bonding apparatus is typically equipped with a temperature controller so that the operator can select the optimum temperature according to the particular substrates, adhesive chemistry, thickness, softening point, and melt flow index. The adhesive must be subjected to heat and pressure for a certain period of time to melt and flow into the fabrics. A general rule of thumb is to use a minimum temperature 25° F. above the chosen adhesive's softening point. This temperature may sometimes be slightly less than the adhesive's melting point, depending on the material selected. As another general rule of thumb, the maximum temperature should usually not exceed the adhesive's melting temperature by more than about 100° F. It is also important that the temperature should be so high as to melt or otherwise damage the substrates, unless they are intended to be melted. The softening point and melting temperature of any adhesive can be obtained from the manufacturer or through routine testing as is known in the art.

The following examples are illustrative, but not limiting, of the methods of the present invention. Other suitable modifications and adaptations of the variety of conditions and parameters normally encountered in the field, and which would be apparent to those skilled in the art, are within the spirit and scope of the invention.

Figure 1B:
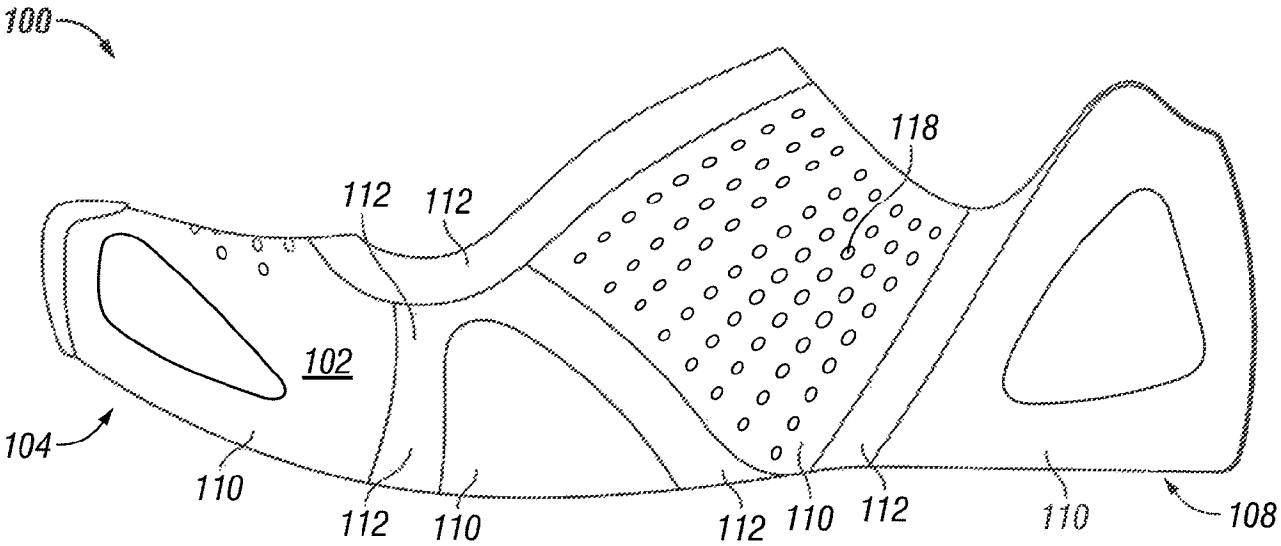

Referring to the drawings and in particular to FIG. 1, an exemplary embodiment of a shoe upper according to the present invention generally referred to by reference numeral 100 is shown. The exterior portion 102 of upper 101 comprises a forefoot region 104, a midfoot region 106, and a heel region 108. Upper 100 is made from a plurality of exterior panels 110 that are bonded together at close seams. In this figure, the upper is shown in its completed state such that the close seams are covered with overlay material 112 adapted to give the exterior portion of said shoe a smooth look and feel.

Overlay material 112 is a trim film which can be cut to a desired geometry to match the underlying close seam it will be employed to cover. The transfer material is adhesively bonded to the exterior of the shoe upper. Suitable transfer materials are produced by Bemis Associates, Inc. of Shirley Mass., such as that available under the model number OT-100, a bi-layer material consisting of a 1 mil thick outer layer of high heat urethane (having a desired exterior color) and a 2 mil thick low melt polyurethane adhesive inner layer (available separately under the model number 3206). In addition to performing the primary function of hiding the close seams (visually and tactilely), the transfer material can add to the aesthetic appeal of the shoe upper. Overlay material 112 can be selected from any number of decorative colors and patterns; for example, a highly reflective material can be used. The transfer material also adds functionality to the shoe; for example, in soccer it is beneficial to have a smooth shoe exterior for optimum kicking control of the soccer ball.

The exterior portion can be made from any suitable material or materials the designer chooses, but in an exemplary embodiment the material is a mesh material 114. The mesh enhances the breathability of upper 100. As an alternative to mesh, a breathable water-resistant textile material could be used. Open-faced materials, such as mesh materials, are challenging to join together using conventional stitching techniques but are easily adaptable to thermoplastic seam tape bonding methods. Upper may also be made from a combination of materials, for example, exterior panels 110 can be made of leather, synthetic leather, plastic, mesh, textile, or any other suitable material and combinations thereof.

Figure 3:
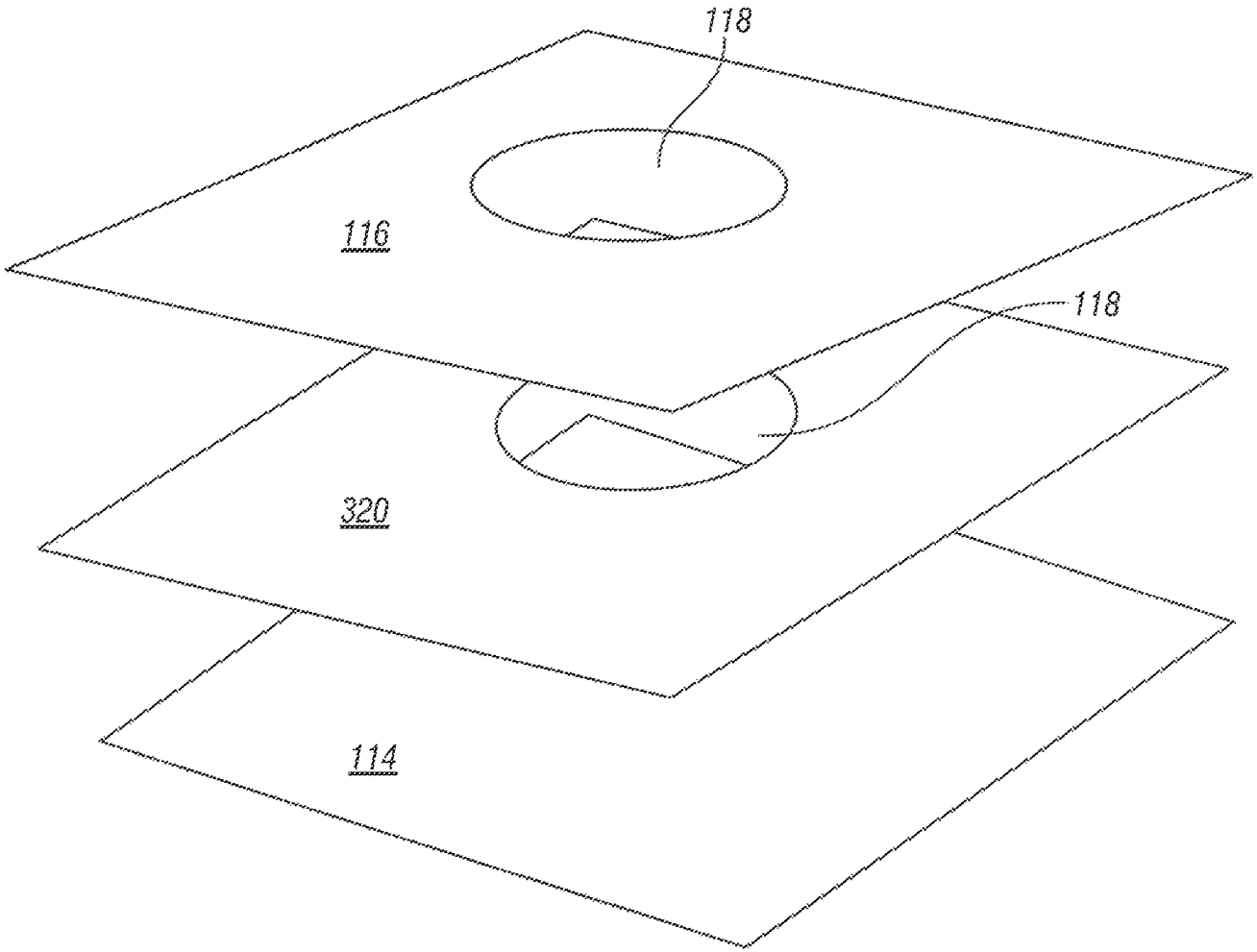
FIG. 3 is an exploded view with an exterior film secured on top of an underlying breathable material with an intermediate layer of adhesive film.

At least a portion of the exterior portion can optionally be covered with a film material 116. A layer of adhesive film 320 is positioned between the mesh material 114 and exterior film 116 as shown in FIG. 3. The exterior film 116 is applied to mesh material 114 with adhesive film 320 using heat transfer techniques or other techniques known in the art, such as RF welding. The film material may incorporate a nylon weave construction. A plurality of openings 118 can be laser cut into exterior film 116 and adhesive film 320. Adhesive film 320 may be of the type sold by Bemis Associates located in Shirley, Mass. under the designation 3405. This tape is a polyurethane tape with a softening point of about 120 degrees Celsius (248 degrees Fahrenheit). Other suitable film materials include polyurethane adhesive films produced by Bemis Associates, Inc. of Shirley Mass. under the model numbers 3410 and 3415. It is advantageous to laser cut the film so that the edges of the openings will not fray. The openings can further enhance the breathability of the upper 100, and can also add to its aesthetic appeal. In the embodiment shown in FIG. 1 there is a plurality of openings 118 *a* in the forefoot region and a plurality of openings 118 *b* on both the medial and lateral sides of the midfoot region. The openings can be put in other locations and can comprise different patterns, shapes, and sizes. The use of film material coupled with laser cutting allows the upper designer to radically alter the look of the upper.

Figure 2A:
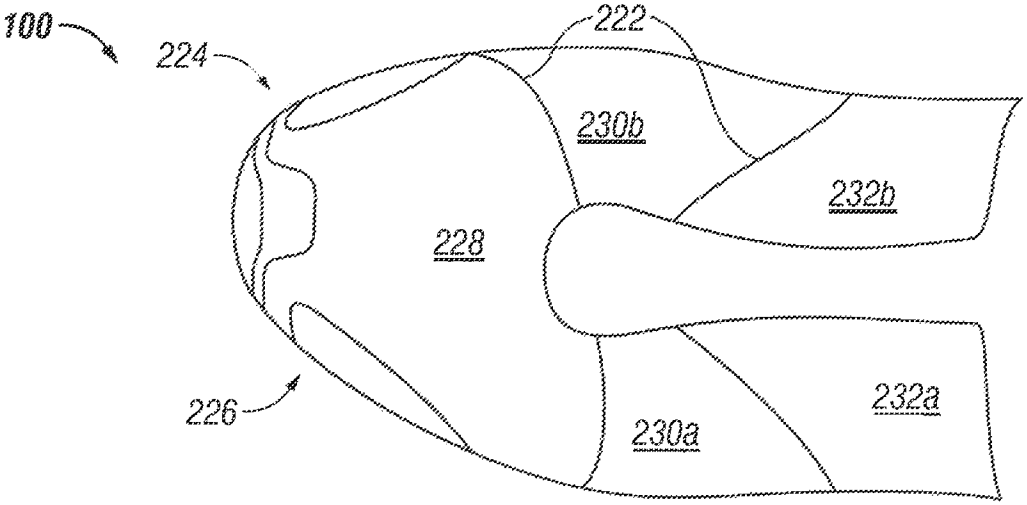
FIG. 2 is a view of the upper of FIG. 1 with the transfer material and films removed showing the exposed close seams.
Figure 2B:
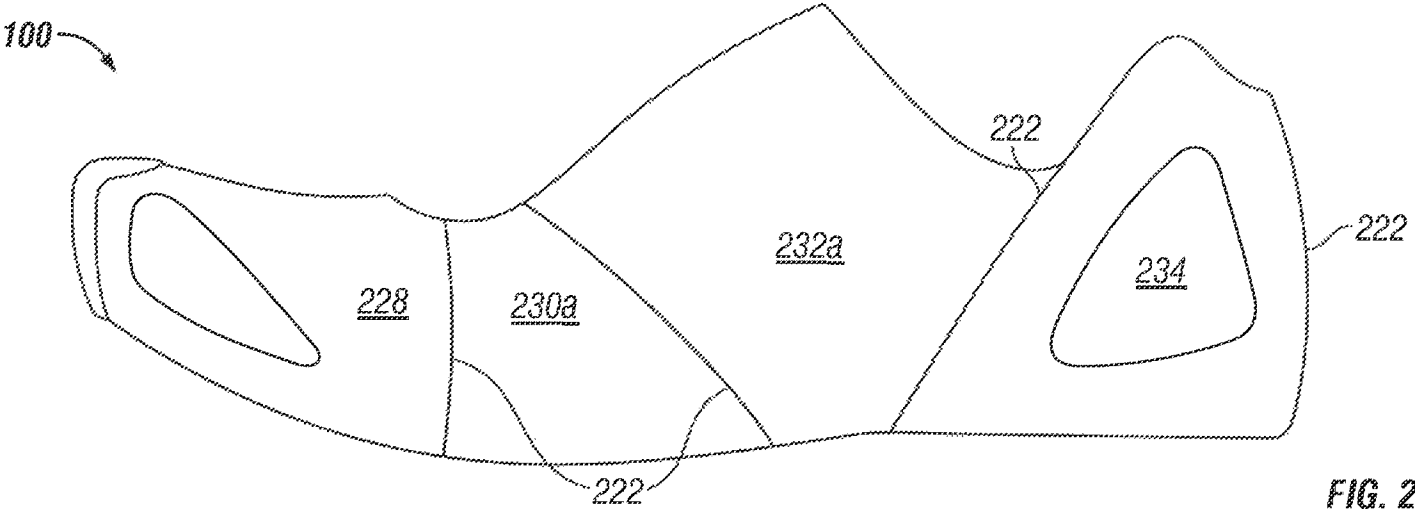

FIG. 2 shows the embodiment of FIG. 1 with the transfer material and films removed so that the close seams 222 are exposed. The upper 100 is divided along a vertical plane into medial 224 and lateral 226 sides. The plurality of exterior panels comprises a forefoot panel 228, a lateral forward midfoot panel 230 *a*, a medial forward midfoot panel 230 *b*, a lateral rear midfoot panel 232 *a*, a medial rear midfoot panel 232 *b*, a lateral heel panel 234, and a medial heel panel (not shown). The panels described are an example embodiment only; other panel arrangements would be apparent to one of ordinary skill in the art. Contiguous exterior panels are connected at close seams. These close seams could comprise traditional stitching, thermoplastic seam tape, hidden seams, or combinations thereof. Thermoplastic seam tape and hidden seams will be described in greater detail below. In the embodiment of FIG. 2, each close seam joins only two contiguous panels, each on opposing sides of the close seam; however, it is within the scope of the present disclosure to have close seams joining more than two contiguous exterior panels.

Figure 4:
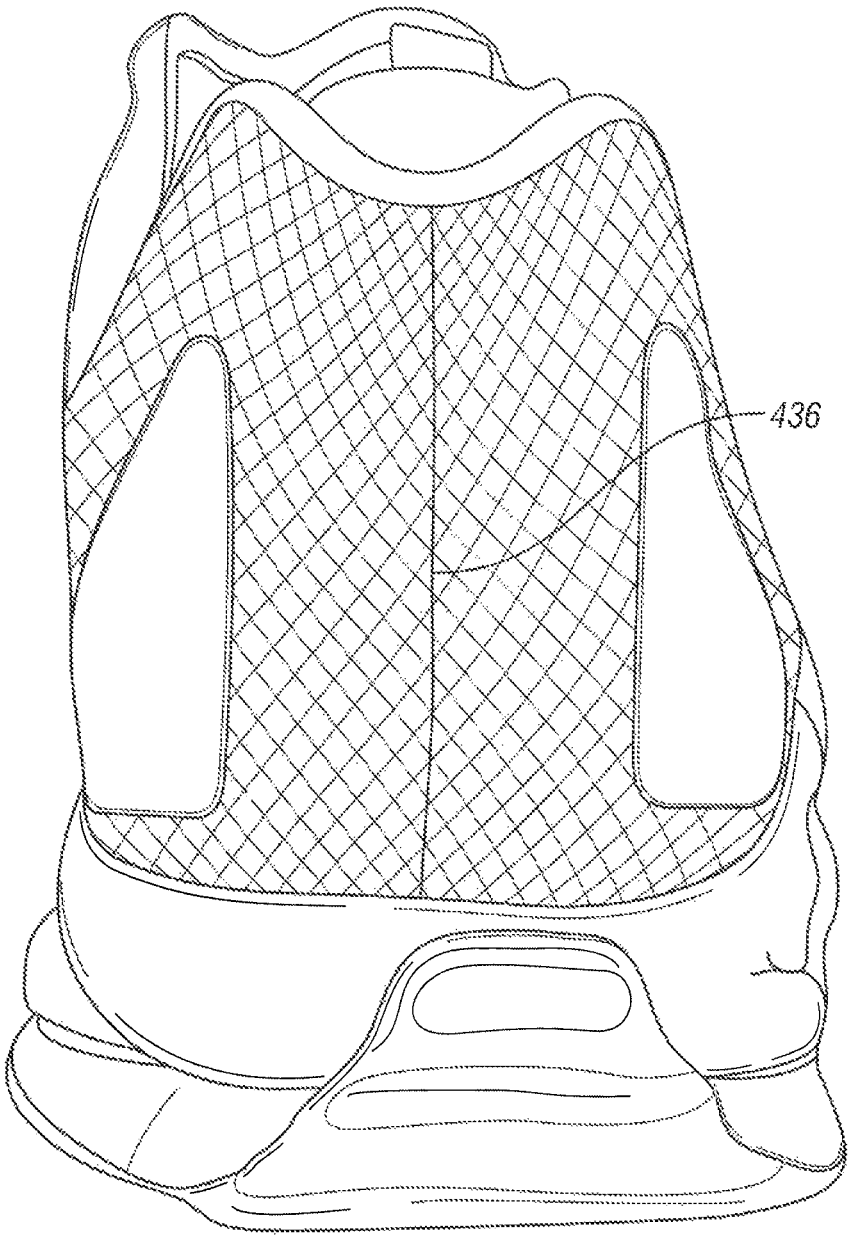
FIG. 4 is a rear view of a shoe showing a hidden seem at the heel portion.

FIG. 4 shows a rear view of one embodiment of the shoe upper. In this embodiment, the close seam at the heel is a hidden seam 436. A hidden seam uses conventional stitching instead of thermoplastic seam tape, but the stitching is hidden in a way that makes the seam appear to be stitchless. During the manufacturing process of such a seam, the upper is turned "inside out" and stitched using techniques known in the art. After the stitching is complete, the upper is then turned right side out. In the embodiment shown, the hidden seam does not have transfer material covering it like the close seams of FIG. 1; however, transfer material can be used on hidden seams if so desired. Although the embodiment shown uses hidden seams at the heel, any of the close seams could be constructed in this manner. Any contiguous exterior panel sections can be joined by any combination of conventional stitching, thermoplastic seam tape, and hidden seam stitching.

Figure 5:
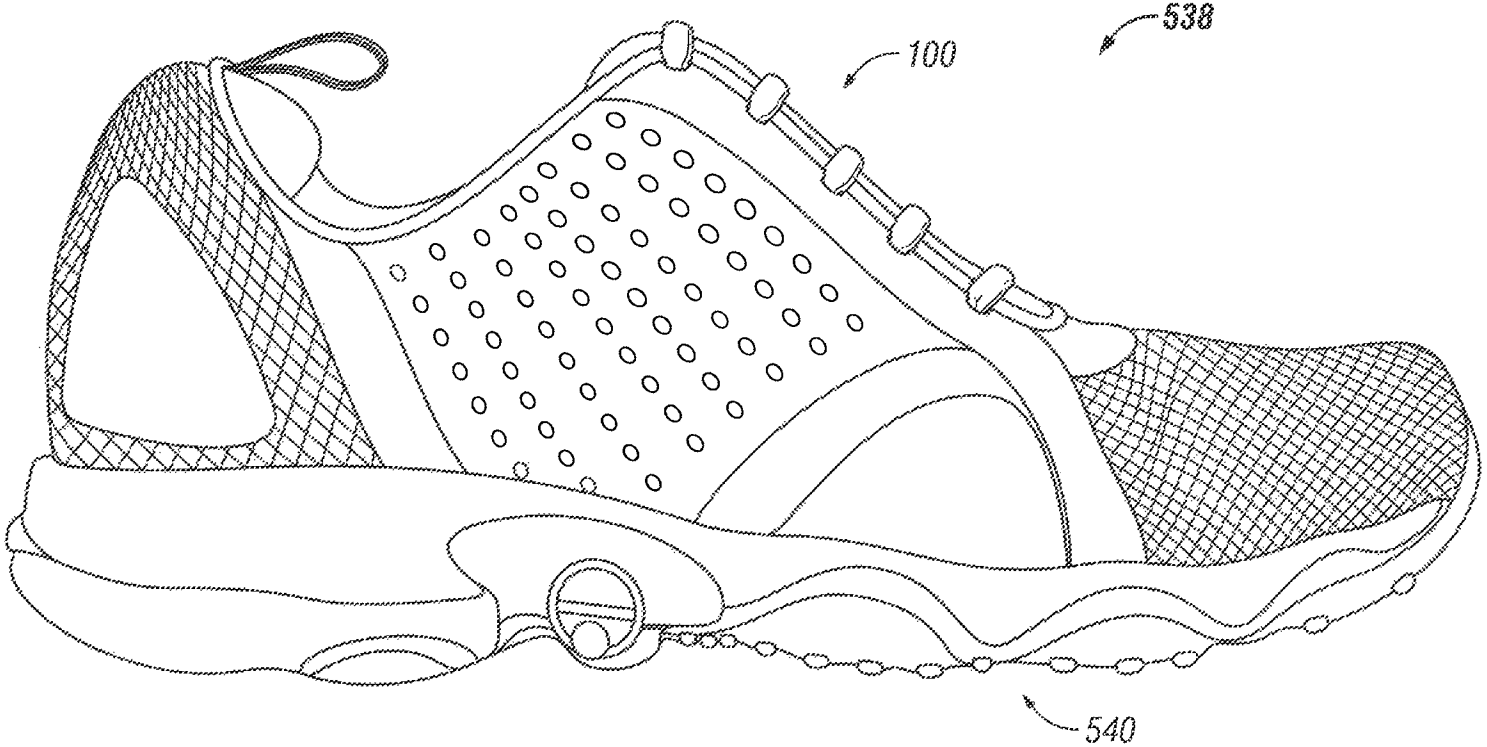
FIG. 5 is a side view of a completed shoe.

FIG. 5 shows a lateral view of an exemplary completed stitchless shoe 538 having a configuration similar to that described above with respect to FIGS. 1 and 2. Upper 100 of shoe 538 is attached to sole 540, which may be made of any conventional material or materials such as EVA foam and rubber and may include a midsole and/or an outsole.

Figure 6:
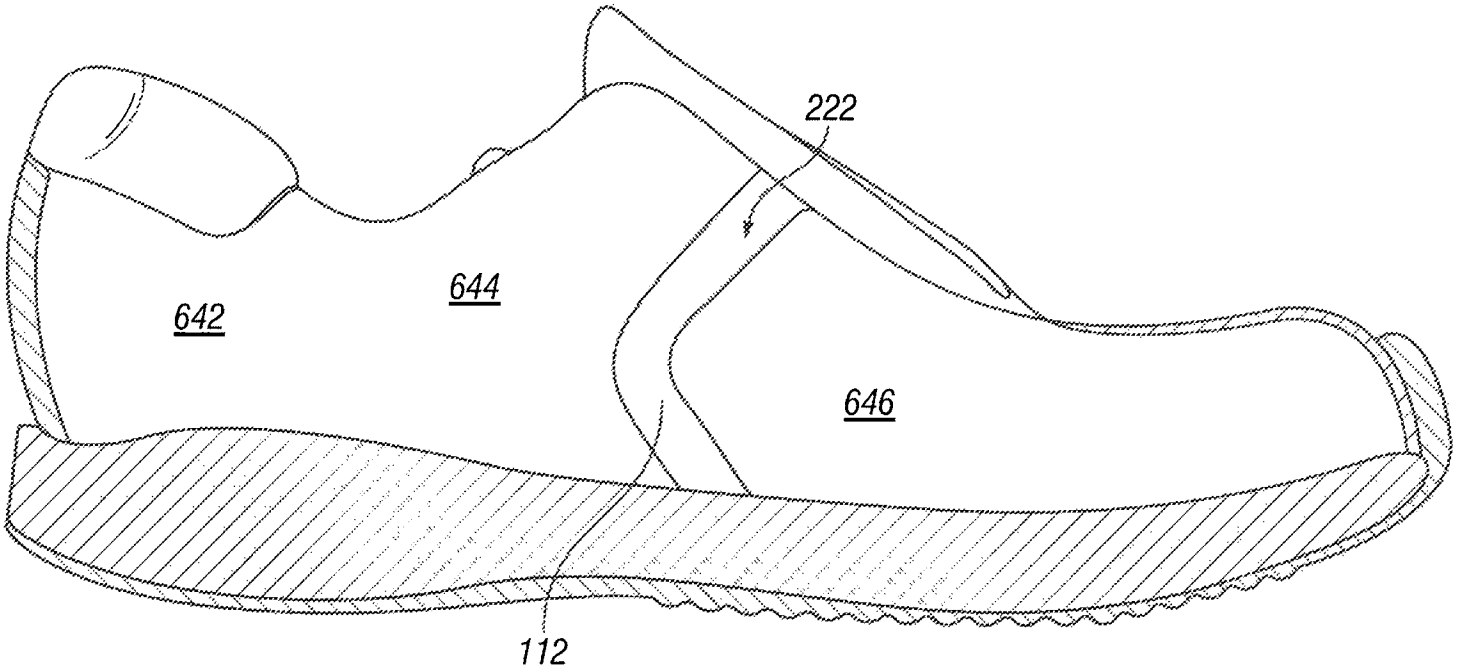
FIG. 6 is a cross-sectional view of an interior of a shoe.

FIG. 6 shows the interior of the shoe upper. The exterior section provides for most of the structural integrity of the upper, but may be uncomfortable to the wearer if directly abutting the wearer's foot. Therefore, it is common for shoes to have an interior portion 642. Interior portion 642 comprises at least in part a compliant material, such as brushed nylon, soft synthetic leather, natural leathers, circular knit and woven textile materials. The interior of the shoe is typically made of one or more flat materials that are attached at their ends to form the interior. The compliant material can be uniform throughout the interior, or different materials and/or thicknesses can be used to selectively put more cushioning only where it is needed. For example, the front of the shoe often does not require as much cushioning as the rear part of the shoe. In the embodiment of FIG. 6, there is a thicker rear interior portion 644 adjacent to the wearer's heel and ankle, and a thinner forward interior portion 646. The interior portions can be joined by stitching or with thermoplastic seam tape 112. As is done with the upper exterior, the close seam 222 at the junction of the interior portions can also be covered with transfer material 112. Using transfer material on interior seam 222 is aesthetically appealing, but perhaps more importantly, minimizes or eliminates any discomfort that the wearer would have from the seam. The use of tape 112 alone, without stitching, to join close seam 222 would also serve to reduce any discomfort that the wearer would have from the seam.

Figure 7:
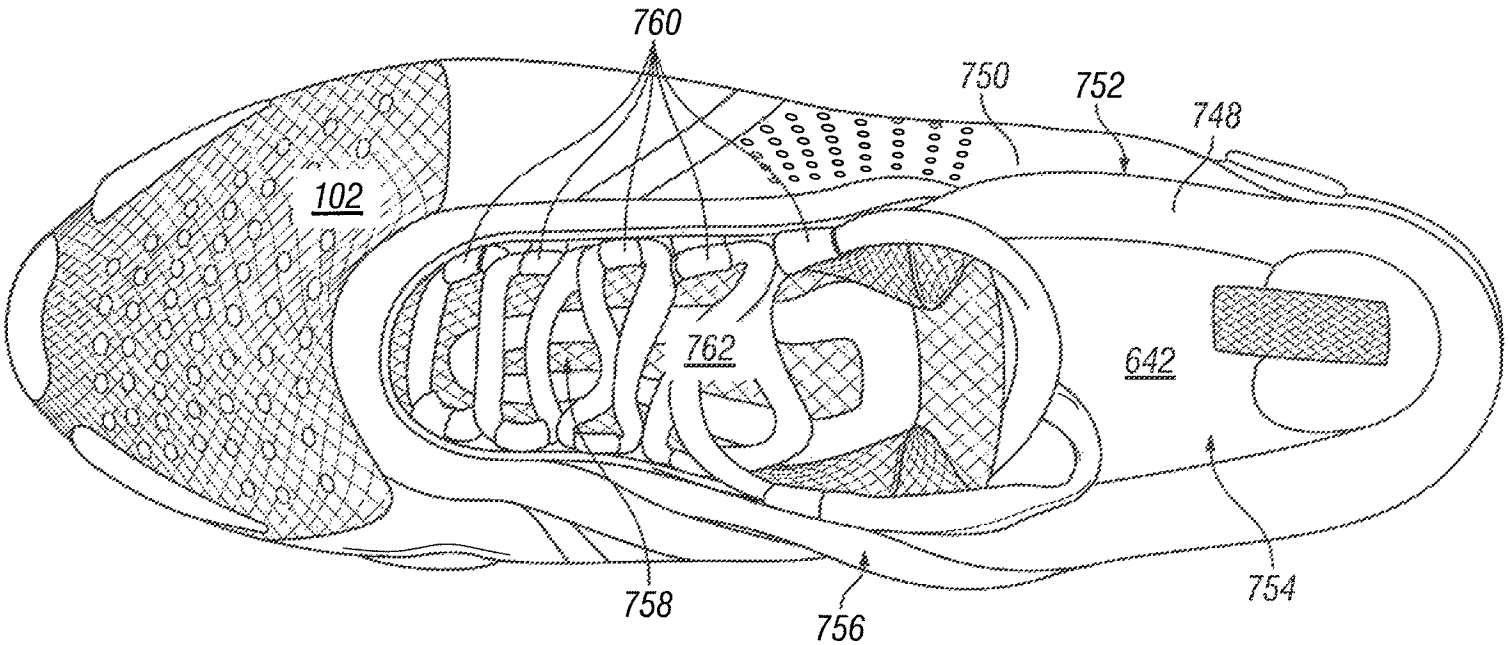
FIG. 7 is a top view of a shoe.

FIG. 7 shows another use of hidden seams other than for joining contiguous exterior panel sections. Interior portion 642 has an interior portion upper edge 748. Exterior portion 102 has an exterior portion upper edge 750. In the embodiment shown, the exterior portion is attached to the interior portion at least partially by stitching a hidden seam 752 located along the juncture of the interior portion upper edge and the exterior portion upper edge. Hidden seam 752 runs along the periphery of ankle opening 754 and along the periphery 756 of tongue opening 762. As discussed above, hidden seam 752 is stitched, but in a way that makes the seam appear to be stitchless. During the manufacturing process of such a seam, the upper is turned "inside out" and stitched using techniques known in the art. After the stitching is complete, the upper is then turned right side out. Tongue pad 758 and shoelace eyelets 760 may also be secured to the upper by hidden seam 752. In one embodiment, a peripheral portion of tongue pad 758 and shoelace eyelets 760 are inserted between interior portion upper edge 748 and exterior portion upper edge 750 and the four layers are stitched together, then turned inside out, so as to be secured by hidden seam 752. Accordingly, stitching can be substantially removed or be made virtually invisible in the area where the interior lining and exterior of the upper are joined. Although not shown, overlay material can be placed on areas of seam 752, in much the same way that overlay material 112 is used to cover close seams 222. As a further alternative, seam 752 could be bonded with thermoplastic seam tape instead of using hidden seam stitching.

Figure 8:
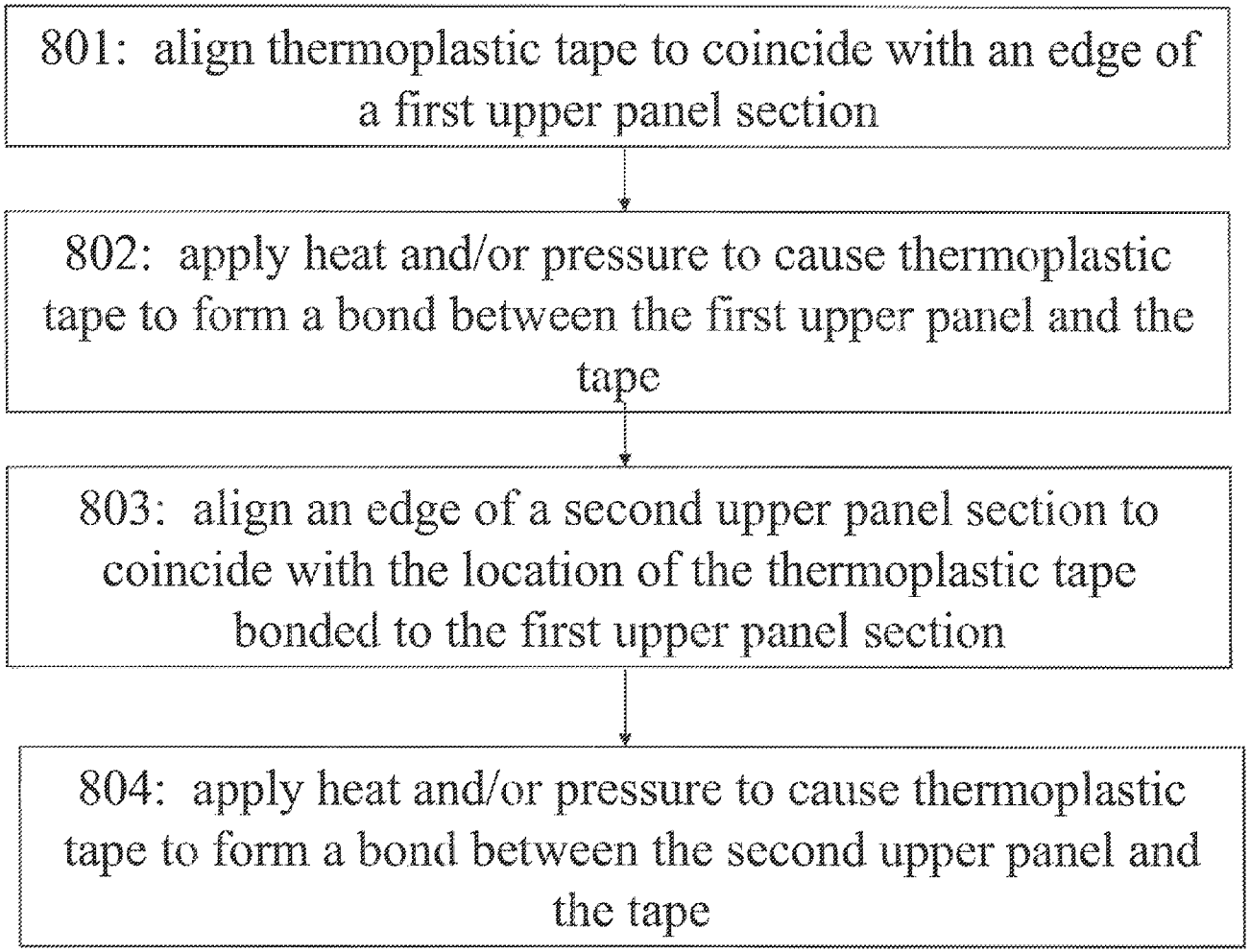
FIG. 8 is a flow diagram displaying a process of bonding exterior panel sections.
Figure 9:
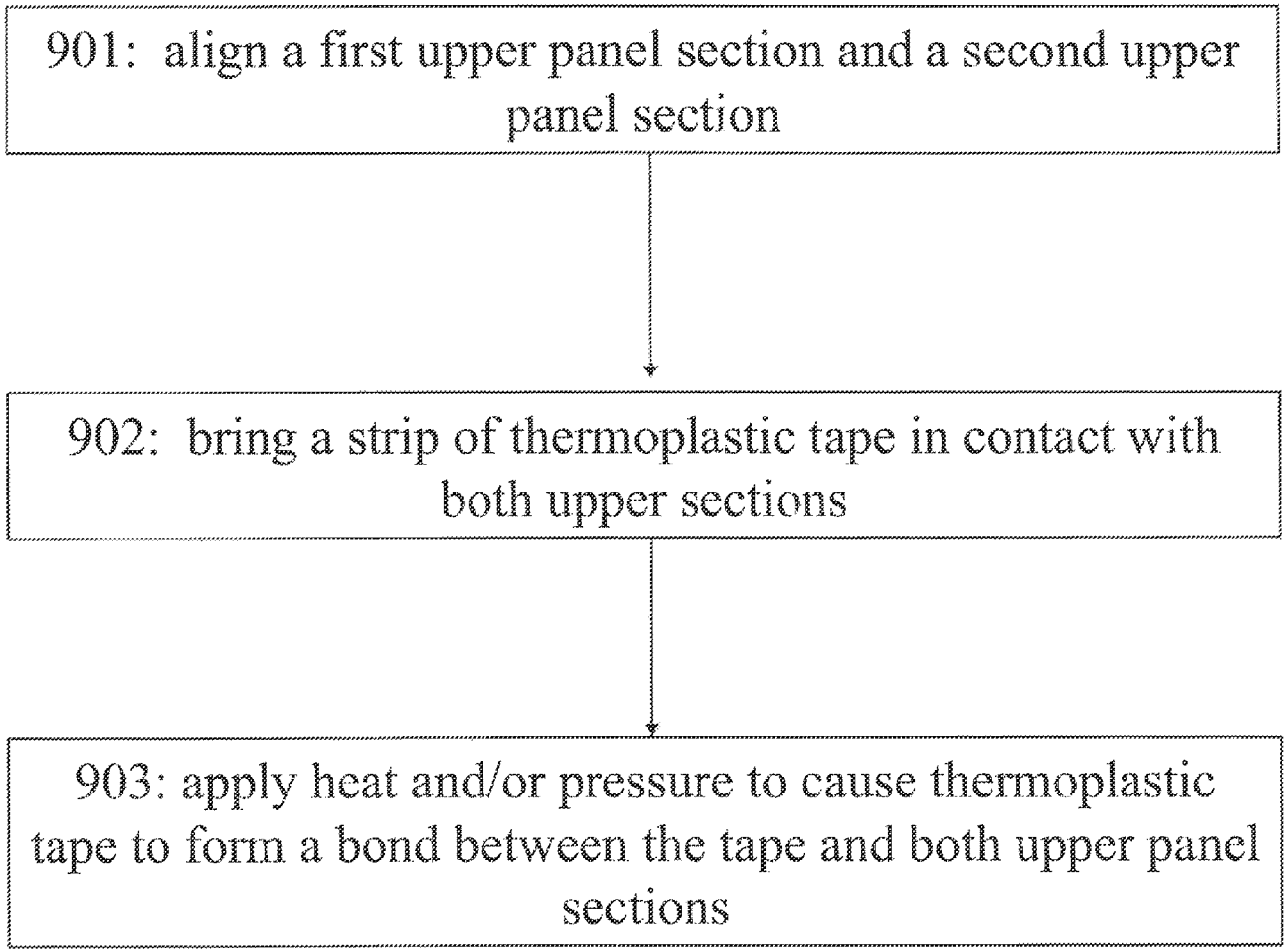
FIG. 9 is a flow diagram displaying an alternative process of bonding exterior panel sections.
Figure 10:
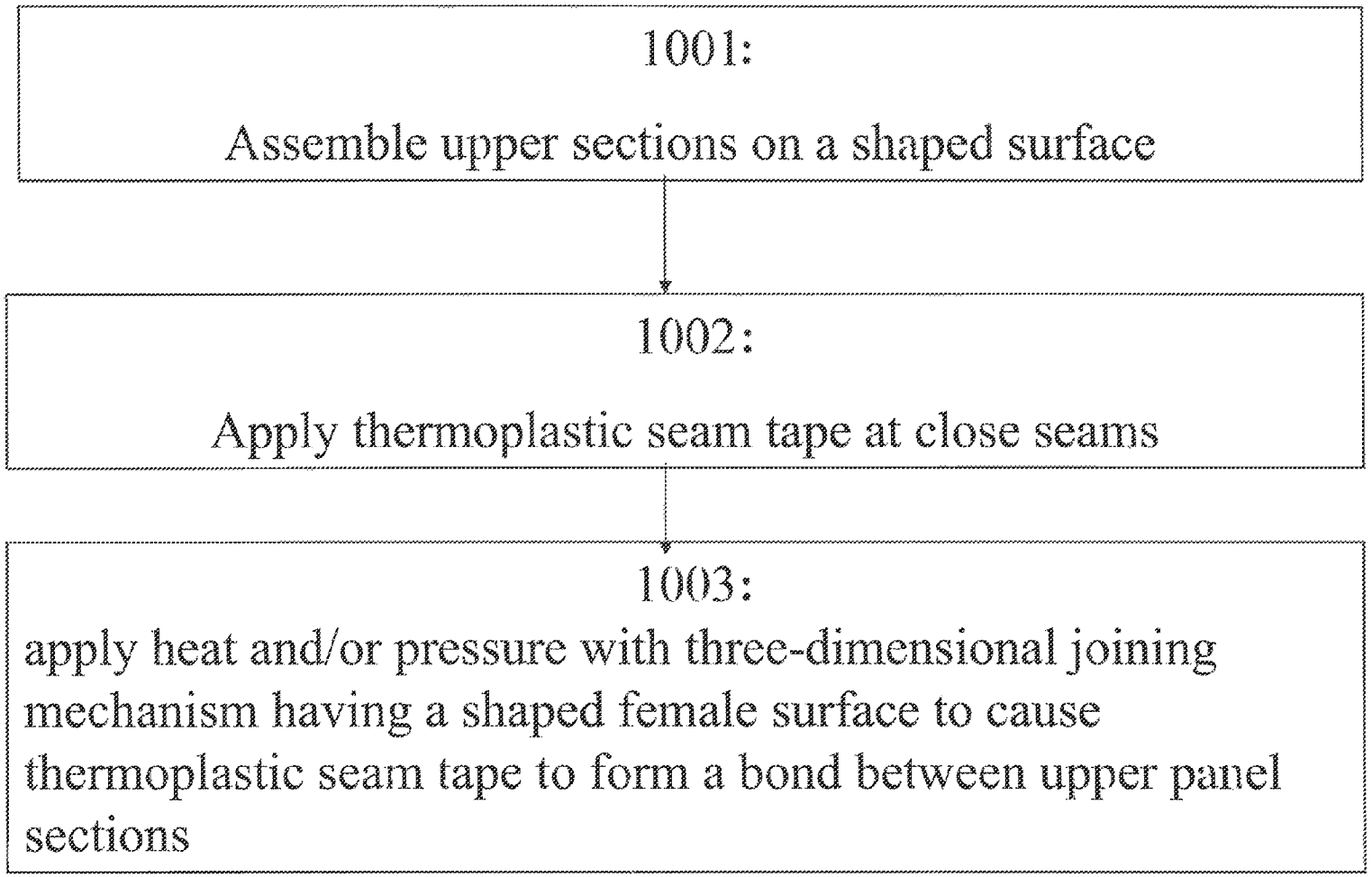
FIG. 10 is a flow diagram displaying a process of bonding exterior panel sections in three dimensions.

FIGS. 8-10 are directed to embodiments of a process for joining contiguous exterior panels using thermoplastic seam tape. While the following processes are described with respect to exterior panels, such processes can also be used to create close seams between interior panels, for example 644 and 646 in FIG. 6. Initially, a plurality of exterior panel sections are manufactured as individual components that will ultimately be joined into the three-dimensional finished upper. A first exterior panel section, such as any of exterior panels 228-234 shown in FIG. 2, is laid flat on a surface; this surface can be a part of the joining mechanism or a separate component. In step 801, a strip of thermoplastic seam tape is carefully aligned to coincide with the first edge of the first exterior panel section. The tape may be of the type sold by Bemis Associates located in Shirley, Mass. under the designation 3405. The strip of thermoplastic tape should have a nominal 10 millimeter overlap on any upper section it is to be bonded on. In step 802, a joining mechanism will be made to come into operative contact with the thermoplastic seam tape and exterior panel combination. As previously discussed, the joining mechanism will apply heat and/or pressure for the appropriate amount of time and cause the thermoplastic seam tape to form bond between the first panel and the seam tape. If there is a concern that thermoplastic seam tape would be made to adhere to joining mechanism during the bonding process, a blocking surface can be positioned on top of tape before mechanism is activated. The blocking material should have a higher softening temperature than the set temperature applied by the joining mechanism. In used, the blocking material must be removed after the first bond is formed in step. The bond formed in step 802 will be the site where a second exterior panel section is joined to the first exterior panel section. The second exterior panel section is also typical of any of exterior panels 228-234 shown in FIG. 2. In step 803, a second edge of the second exterior panel section is carefully aligned to coincide with the location of the thermoplastic seam tape. In step 804 a joining mechanism will be made to come into operative contact with the thermoplastic seam tape and exterior panels combination. As previously discussed, the joining mechanism will apply heat and/or pressure for the appropriate amount of time and cause the thermoplastic seam tape to form a second stitchless bond between the second exterior panel and the seam tape. At the conclusion of the process illustrated in FIG. 8, the two contiguous exterior panels are joined in a stitchless manner. The process can be repeated as desired at other close seams.

In another embodiment, two contiguous exterior sections can be thermoplastically bonded with a single activation of heat and/or pressure by a joining mechanism. Initially, a plurality of exterior panel sections are manufactured as individual components that will ultimately be joined into the three-dimensional finished upper. In step 901, a first and a second exterior section are aligned and laid out on surface; this surface can be a part of the joining mechanism or a separate component. In step 902, a strip of thermoplastic seam tape is brought into contact with both of the exterior sections. The strip can be laid on top of the juncture between the first and second exterior sections. Alternatively, the strip could be laid between an overlapping region of the first and second exterior sections. In step 903, a joining mechanism is activated. A first bond is formed between the tape and the first exterior panel section, a second bond is formed between the tape and the second exterior panel section. If there is a concern that thermoplastic seam tape would be made to adhere to the joining mechanism during the bonding process, a blocking surface can be positioned on top of the tape before the joining mechanism is activated. If used, the blocking material must be removed after the bonding process. At the conclusion of the process illustrated in FIG. 9, the two contiguous exterior panels are joined in a stitchless manner. The process can be repeated as desired at other close seams.

As described above with particular reference to FIGS. 8-9, a shoe upper can be constructed from a plurality of exterior panel sections which are substantially flat. The surface supporting the exterior panel sections during the bonding process as well as the joining mechanism may also be substantially flat. However, while conventional stitching machines may be restrictively limiting to the upper manufacturing process, because such stitching machines generally cannot handle an irregularly shaped or three-dimensional seam line, the thermoplastic seam tape stitchless bonds of the present invention have increased capability in this arena. In particular, three-dimensional exterior panel sections can be bonded together using thermoplastic seam tape. Such three-dimensional exterior panel sections may comprise, for example, molded sections. Three-dimensional panel sections can be bonded to two-dimensional sections as well.

To employ the methods of FIGS. 8-9 on three dimensional sections, the sections are first assembled on a last or other shaped male surface having the shape of the desired shoe upper, in step 1001. The three-dimensional last is analogous to the two-dimensional surface used for flat bonding. In step 1002, thermoplastic seam tape is applied at the close seams according to the flat bonding procedure. In step 1003, a three-dimensional joining mechanism having a shaped female surface or interior shape that is substantially the same shape as the exterior shape of the last can be used to apply heat and pressure to the three-dimensional close seams. The three-dimensional joining mechanism is analogous to the joining mechanism used for flat bonding.

Since the process of using flat tapes, as described in FIG. 8, requires the adhesive tape to be bonded to a first exterior panel section before the second section is overlapped and bonded such methods would preclude the possibility of joining all the close seams in a single application of the three-dimensional joining mechanism. However, the methods can be altered to include the possibility of imparting the thermoplastic seam tape with some amount of "tackiness" prior to the bonding operations. The tapes can be made "sticky" enough to temporarily hold the exterior panel sections together on the last in the desired configuration. One method to provide tackiness to the thermoplastic seam tape is to spot weld portions of the tape, thereby temporarily partially melting portions thereof. The last itself may also have a tack surface to hold the exterior panels in place prior to the bonding process. Alternatively, the last could have a suction surface or a combination tack and suction surface. Once all the panels are assembled and in the proper configuration, the three-dimensional joining mechanism can be activated thereby bonding all of the close seams simultaneously in a single operation with pressure and/or heat. This would lead to a decrease in production time and an associated cost savings.

Figure 11:
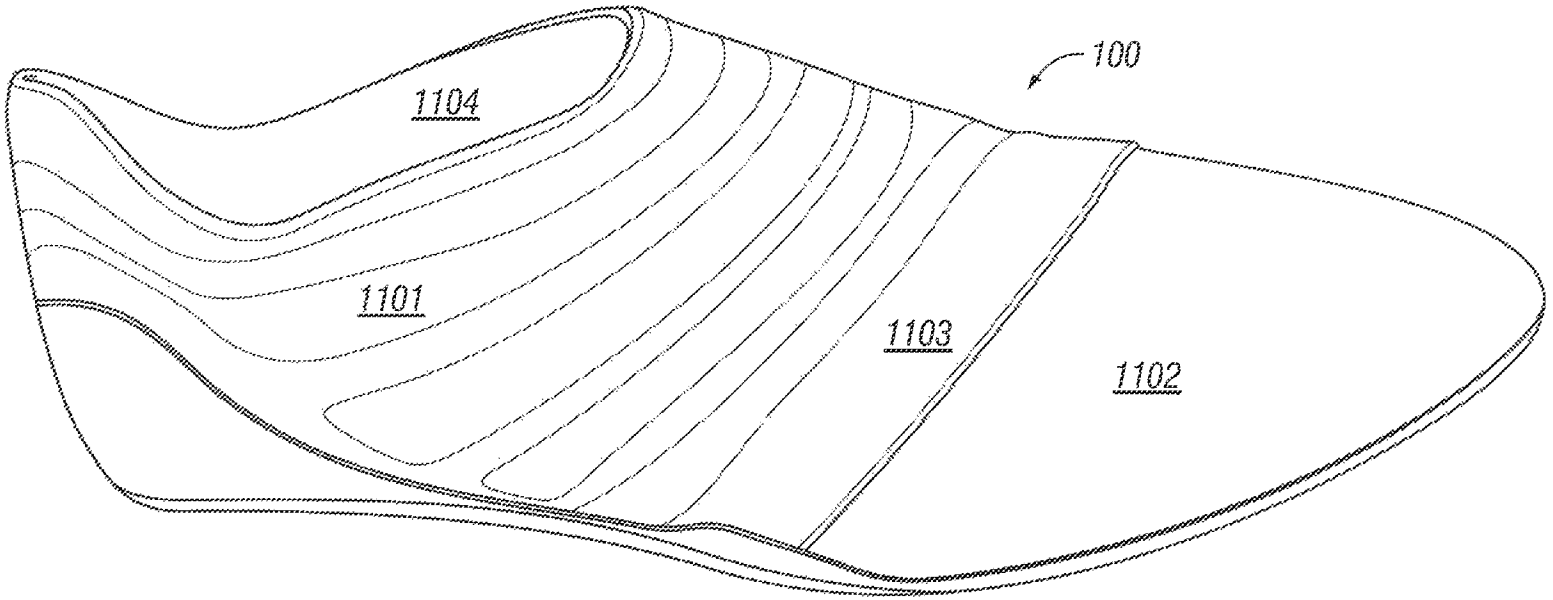
FIG. 11 is a side view of a completed shoe formed in accordance with the process of FIG. 10.

FIG. 11 shows an upper 100 manufactured according to the present invention. Upper 100 is assembled by aligning rear segment 1101 and forefoot segment 1102 on a flat surface and joining these segments to create a close seam. An overlay material 1103 was cut to a desired geometry to match the underlying close seam and employed to cover the close seam. As an alternative, the upper shown in FIG. 11 could be manufactured in three-dimensions, as described above, on male last 1104.

The process described above may be especially useful with uppers including bladders, such as the bladders disclosed in U.S. Pat. No. 6,785,985 to Marvin et al. which are sometimes incorporated into shoe uppers to provide fit, cushioning, stability, or to improve athletic performance. These bladders may be sandwiched between the upper materials. Alternatively, the bladders can function as an exoskeleton, actually comprising a part of the upper exterior. Inflatable shoe bladders may sometimes be made of two sheets of a polymer material welded around their peripheral edges forming an airtight seal. A portion of the peripheral weld line can function as a stitch line, whereon conventional stitching is used to secure the bladder to other parts of the shoe upper. This technique poses a risk of accidentally rupturing the bladder or otherwise harming the integrity of the airtight seal, which could be a substantial source of wasted raw materials, money, and time.

To substantially eliminate the risk of accidentally damaging the bladder during the manufacturing process, thermoplastic seam tape can be used in lieu of conventional stitching to attach the bladder to other components of the upper.

Figure 12:
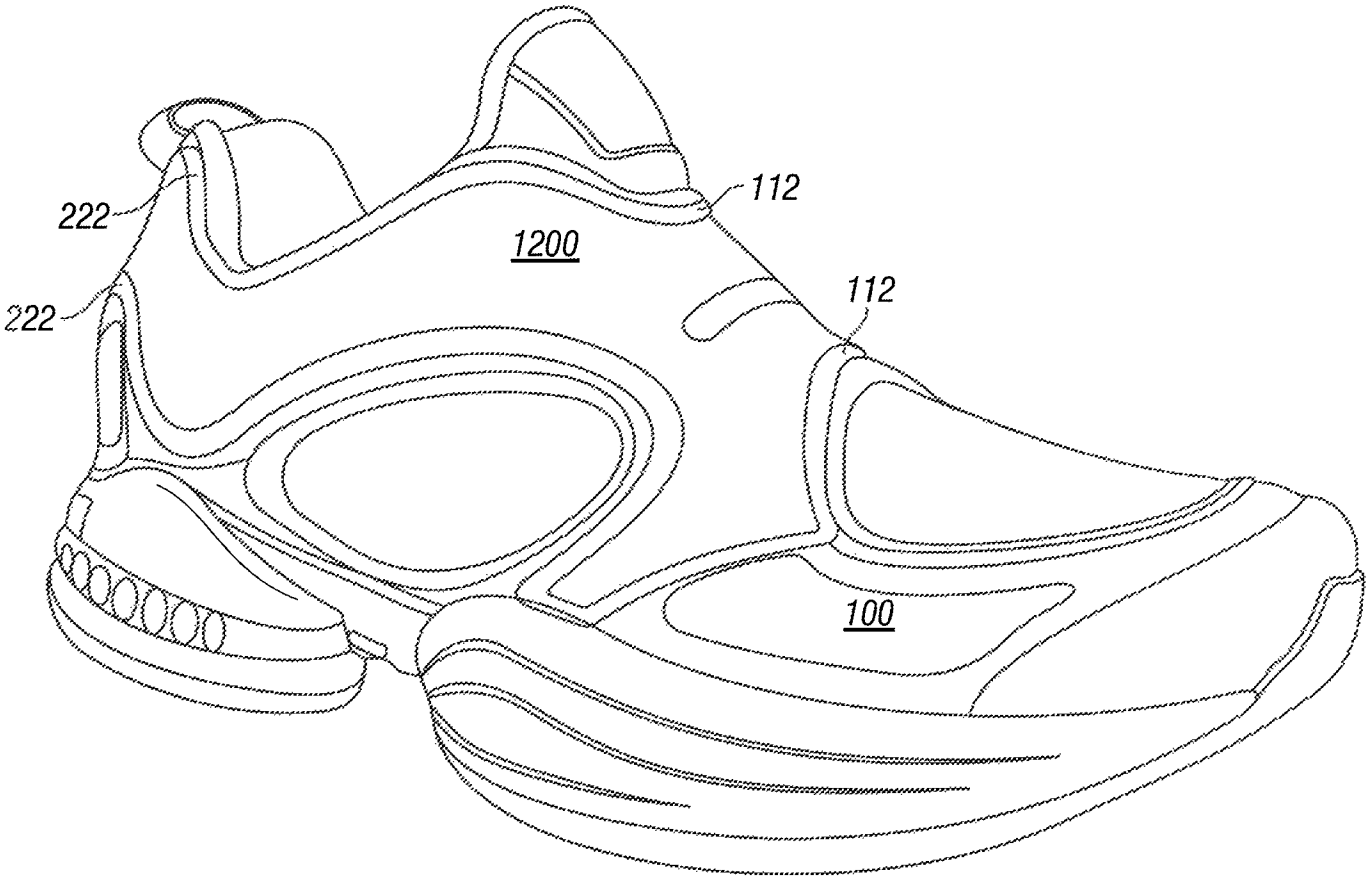
FIG. 12 is a perspective view of a shoe upper comprising an inflatable bladder.

In FIG. 12, an inflatable bladder exoskeleton 1200 is disposed in the upper around the ankle and midfoot area, as described in U.S. Published Patent Application No. 2005/0028404. Bladder 1200 permits the wearer to adjust the fit of the upper. According to the present invention, the periphery of bladder 1200 may be joined to conventional upper materials 100 at close seam 222 by thermoplastic tape, as described above. Using thermoplastic tape at close seam 222 substantially reduces the risk of accidental rupture of bladder 1200 as compared to conventional stitching. Manufacturing inflatable footwear in such a manner allows for inflatable bladders made from two flat sheets of polymer material, such as described in U.S. Published Patent Application No. 2005/0028404, to be joined to molded footwear upper components in a three-dimensional manner on a last or other shaped male surface, as described above, where conventional stitching would not be possible. Close seam 222 may farther comprise a strip of overlay material 112 adapted to give the upper a smooth look and feel.

It should be noted that the terms "first," "second," "upper," "lower" and the like may be used herein to modify various elements. These modifiers do not imply a spatial, sequential, or hierarchical order to the modified elements unless specifically stated.

The foregoing description of the embodiments are presented for purposes of illustration and description. The description is not intended to be exhaustive or to limit the invention to the precise form disclosed, and obviously many modifications and variations are possible in light of the above teachings. While this invention has been particularly shown and described with reference to preferred embodiments thereof, it will be understood by those skilled in the art that various changes in form and details may be made therein without departing form the spirit and scope of the invention. Thus, the breadth and scope of the present invention should not be limited by any of the above-described exemplary embodiments, but should be defined only in accordance with the following claims and their equivalents.

What is claimed is:

1. A method of making an upper for an article of footwear, comprising:

coupling a first molded three-dimensional upper section to a second molded three-dimensional upper section to provide a seam;

positioning a thermoplastic seam tape on at least a portion of the seam that is between the first molded three-dimensional upper section and the second molded three-dimensional upper section;

after positioning the thermoplastic seam tape, arranging the first molded three-dimensional upper section and the second molded three-dimensional upper section on a three-dimensional last surface having an outer shape substantially corresponding to a desired three-dimensional shape for the upper; and forming a bond between the thermoplastic seam tape and the first and second molded three-dimensional upper sections at the seam while the first and second molded three-dimensional upper sections are arranged on the three-dimensional last surface, wherein the forming includes applying heat and pressure to form the bond between the thermoplastic seam tape and the first and second molded three-dimensional upper sections.

2. The method of claim 1, wherein the seam is a stitched seam.

3. The method of claim 1, wherein the seam is a stitchless seam.

4. The method of claim 1, wherein the thermoplastic seam tape is positioned on an innermost surface of the first molded three-dimensional upper section and the second molded three-dimensional upper section.

5. The method of claim 1, wherein the thermoplastic seam tape is positioned on an outermost surface of the first molded three-dimensional upper section and the second molded three-dimensional upper section.

6. The method of claim 1, wherein the thermoplastic seam tape is positioned on an innermost surface of the first molded three-dimensional upper section and the second molded three-dimensional upper section and an outermost surface of the first molded three-dimensional upper section and the second molded three-dimensional upper section.

7. The method of claim 1, wherein the last surface comprises a shaped male surface, and wherein the forming includes joining the shaped male surface with a corresponding shaped female surface.

8. The method of claim 1, wherein the first molded three-dimensional upper section comprises a forefoot section and the second molded three-dimensional upper section comprises a rear section.

9. The method of claim 1, further comprising cutting the thermoplastic seam tape to a desired geometry corresponding to the seam between the first and second molded three-dimensional upper sections.

10. The method of claim 1, wherein at least one of the first molded three-dimensional upper section and the second molded three-dimensional upper section comprises a multilayer laminate.

11. The method of claim 1, further comprising removing the first and second molded three-dimensional upper sections from the shaped surface.

12. The method of claim 1, wherein the first molded three-dimensional upper section and the second molded three-dimensional upper section do not overlap at the seam.

13. The method of claim 1, wherein the seam is disposed entirely on one of a medial and a lateral side of the upper.

14. The method of claim 1, further comprising cutting the thermoplastic seam tape to a geometry having curved edges corresponding to the seam shape between the first and second molded three-dimensional upper sections.

15. The method of claim 1, wherein the positioning includes attaching the thermoplastic seam tape on at least a portion of the seam.

16. The method of claim 1, further comprising cutting the thermoplastic seam tape to a non-linear shape substantially matching a shape of the seam.

17. A method of making an upper for an article of footwear, comprising:

arranging a first molded three-dimensional upper section and a second molded three-dimensional upper section on a male last surface having an outer shape substantially corresponding to at least a portion of a three-dimensional shape for the upper; and applying heat and pressure to a thermoplastic seam tape oriented on the first and second molded three-dimensional upper sections to attach the first molded three-dimensional upper section and the second molded three-dimensional upper section while the first molded three-dimensional upper section and the second molded three-dimensional upper section are arranged on the male last surface, wherein the heat and pressure is applied to the first molded three-dimensional upper section and the second molded three-dimensional upper section between the male last surface and a female last surface having an interior shape substantially the same as the male last surface.

18. The method of claim 17, wherein the first upper section is a molded three-dimensional upper section corresponding to a forefoot portion of a foot.

19. The method of claim 17, wherein the thermoplastic seam tape is oriented on an outermost surface of the first molded three-dimensional upper section and the second molded three-dimensional upper section.

20. The method of claim 17, wherein the thermoplastic seam tape is oriented on an innermost surface of the first molded three-dimensional upper section and the second molded three-dimensional upper section.

21. The method of claim 17, wherein the first molded three-dimensional upper section comprises a forefoot section and the second molded three-dimensional upper section comprises a rear section.

22. The method of claim 18, wherein the applying heat and pressure includes applying heat through at least one of the male last surface and the female last surface.

23. A method of making an article of footwear, comprising:

coupling a first molded three-dimensional upper section to a second molded three-dimensional upper section to provide a seam;

positioning a thermoplastic seam tape on at least a portion of the seam between the first molded three-dimensional upper section and the second molded three-dimensional upper section;

after positioning the thermoplastic seam tape, arranging the first molded three-dimensional upper section and the second molded three-dimensional upper section on a three-dimensional last surface having an outer shape substantially corresponding to a desired three-dimensional shape for the upper; and forming a bond between the thermoplastic seam tape and the first and second molded three-dimensional upper sections at the seam while the first and second molded three-dimensional upper sections are arranged on the last surface; and attaching the upper to an outsole, wherein the first upper section and the second molded three-dimensional upper section define an outermost surface of the article of footwear.

24. The method of claim 23, wherein the seam is formed along at least one of a medial side and a lateral side of the article of footwear.

* * * * *